United States Patent [19]

Gourmel

[11] 4,456,053

[45] Jun. 26, 1984

[54] APPARATUS FOR SUPPORTING AND CENTERING A DIE CORE IN CONTINUOUS TUBE CASTING

[75] Inventor: Yves Gourmel, Pont A Mousson, France

[73] Assignee: Pont-A-Mousson S.A., Nancy, France

[21] Appl. No.: 393,945

[22] Filed: Jun. 30, 1982

[30] Foreign Application Priority Data

Jul. 6, 1981 [FR] France ..... 81 13239

[51] Int. Cl.[3] ..... B22D 11/00; B22D 11/04

[52] U.S. Cl. ..... 164/421; 164/465

[58] Field of Search ..... 164/418, 421, 422, 464, 164/465

[56] References Cited

U.S. PATENT DOCUMENTS 560,484 5/1896 Dupont ..... 164/421 X 2,502,312 3/1950 Danner ..... 164/421 X

FOREIGN PATENT DOCUMENTS 502703 4/1976 U.S.S.R. ..... 164/464

*Primary Examiner*—Kuang Y. Lin

*Assistant Examiner*—J. Reed Batten, Jr.

*Attorney, Agent, or Firm*—Sughrue, Mion, Zinn, Macpeak and Seas

[57] ABSTRACT

A cap 42 with a lower spherical surface 46 is held against the flared head 38 of a casting core 24 and rests on the spherical upper surface of an annular bed 50 which is fixed above a casting head 12. The bed is coaxial with an enlarged orifice 40 for the passage of the core, and is coaxial with a casting tank 16. Projections 70 are distributed regularly around the periphery of the core and come into contact with the internal wall of a mold 22 near a die opening to center the core in the mold by possibly moving the cap in relation to the bed, before final tightening.

10 Claims, 6 Drawing Figures

APPARATUS FOR SUPPORTING AND CENTERING A DIE CORE IN CONTINUOUS TUBE CASTING

BACKGROUND OF THE INVENTION

The present invention relates to the continuous vertical casting of metal or metal alloy tubes, and more particularly to the continuous casting of low thickness cast iron tubes using a die comprising a mold and a mandrel or cylindrical core, which is coaxial to the mold, and which defines an annular space for the casting of the tube. The invention is specifically concerned with the centering of the core or mandrel in the die.

The problem of centering the core in relation to the die is particularly acute in the casting of thin tubes having a low thickness/diameter ratio, whose thickness does not exceed a few millimeters, and particularly, as in the case of the present invention, tubes with a thickness/exterior diameter ratio of less than 8% and of a thickness of less than 5 mm. In effect, the slightest off-centering of the core in relation to the mold causes considerable irregularity in the thickness of the tube over the entire periphery of the die. For example, for a desired thickness of 3 mm, an off-centering of 0.5 mm causes a relatively important irregularity which can be from 1 to 3 mm, i.e., 33%. Such an off-centering can easily arise due to machining tolerances and/or slightly heterogeneous dilation of the core during heating.

As discussed in applicant's French Pat. No. 2,415,501, when the core is centered by adjusting it in an upper orifice of the casting head or box, the manufacturing tolerances of the casting head or box and the orifices intended to be traversed by the core are too wide for very low thicknesses, in particular those less than 5 mm, and the centering of the core is difficult to accomplish.

In accordance with another technique, known from French Pat. No. 1,485,055, an assembly with a sleeve or sheath and with a guiding bearing fitted by stamping into the sleeve or sheath provides precise centering of the mandrel in relation to the casting die of a tube. However, such a technique calls for precise adjustment which is difficult to achieve.

Precise adjustment is also called for if, as is known, a core with a centering range is used in the mold or shell.

In another prior art technique (French Pat. No. 2,077,405) using an ingot mold for the manufacture of tubular profiles, the problem of centering the mandrel in relation to the mold is resolved by inserting a cylindrical base of the mandrel in a corresponding cylindrical cavity of the mold with, in addition, a threading to axially immobilise the mandrel in the mold. In addition to the fact that this assembly comprises a threading which is difficult to machine, it does not provide a satisfactory solution to the problem of the continuous casting of thin cast iron tubes.

SUMMARY OF THE INVENTION

The object of the present invention is thus to enable the precise centering of the core in relation to the die, using material whose manufacturing tolerances are normally considerably greater than those which are normally required for such centering or alignment, that is, from assemblies with considerable play.

This object is implemented by providing an apparatus for the support and centering of a cylindrical core inside the annular die of a vertical continuous casting installation for thin tubes, comprising a casting head or box, which connects a casting pocket to the narrow annular space of the die, characterized by a ball-and-socket joint for supporting the core between the upper end of the core and the upper part of the casting head. The core traverses this casting head with considerable play, and for centering the core in the mold inside the annular space of the die, a series of identical projections or lugs, regularly spaced around the periphery of the core and in contact with the internal wall of the mold, are provided at the upper opening of the die, at a level of immersion in the liquid metal during casting.

Due to the combination of the ball-and-socket joint support above the box together with a loose assembly of the upper part of the core, and the centering projections or lugs arranged beneath at the lower part of the box at the opening of the annular die, the core is perfectly centered in relation to the mold and, thus, perfectly aligned with the extractor when the mold itself is aligned therewith.

According to a preferred embodiment, the upper end of the core is connected to a support cap having a spherical lower surface, which is supported on an annular bed with a matching spherical upper surface fixed coaxially above the casting head.

The simple introduction of the core into the mold and the lugs coming in contact with the wall of the mold automatically center the core in relation to the die and place the cap in stable and sure support on the annular bed, whatever the off-centering of the die in relation to the bed.

The lugs may have various shapes providing punctual contact, or on very small surfaces, with the wall of the mold. In all cases they take up a small volume in relation to that of the annular space and are sufficiently near the opening of the die so as only to be surrounded by liquid metal.

DETAILED DESCRIPTION OF THE PREFERRED EMBODIMENTS

Figure 1:
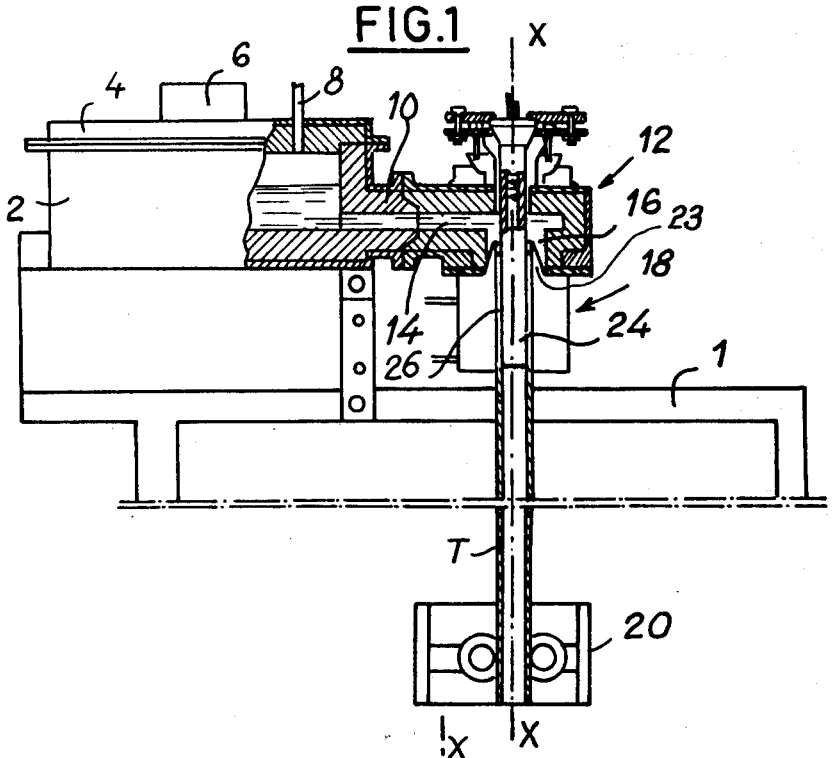
FIG. 1 is a schematic elevation view, with partial small-scale cross-section, of a continuous casting installation with an annular die in accordance with the invention during the casting of a tube.

An installation for the vertical continuous casting of a tube T in cast iron with a low exterior thickness/diameter ratio, less than 8%, and having a thickness less than 5 mm, is shown in FIG. 1. It comprises, in a manner known per se, a frame 1 which supports at its upper part a casting vessel 2 which is hermetically closed by a cover 4. The vessel contains a filling orifice obturated by a plug 6, and is traversed by a pipe 8 connected to a source of gas under pressure, which is not shown.

The casting vessel is extended by a casting nozzle 10 on which is fixed in a sealed but movable manner a casting head or box 12 of the channel or square pipe type, comprising a channel 14 in the extension of the nozzle 10 and a casting tank 16 with an XX axis perpendicular to the channel 14. A die 18 exits into the tank 16 and should be coaxial to both the tank and to an extractor device 20, also with an XX axis, which is fixed under the frame.

Figure 2:
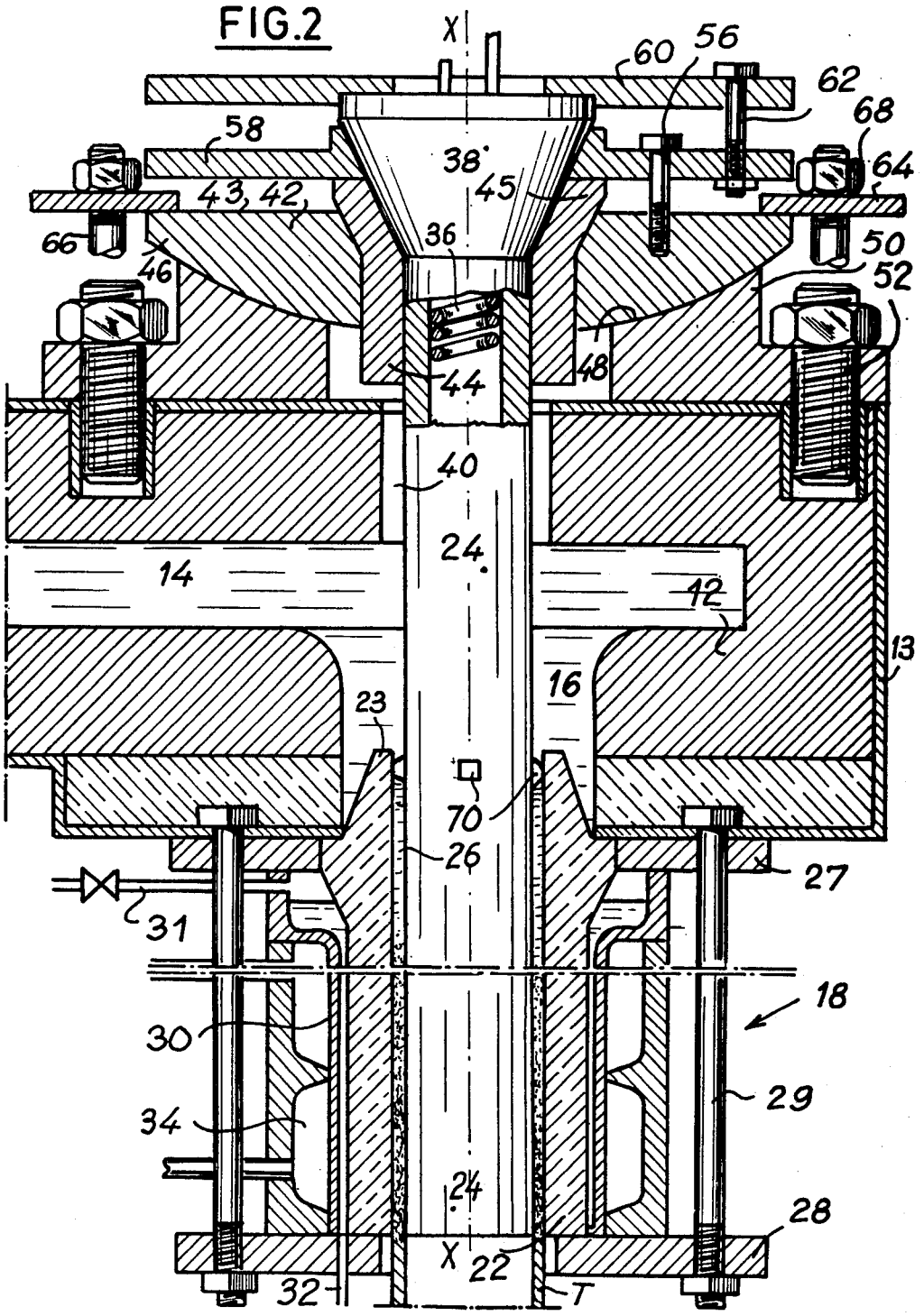
FIG. 2 is a partial cross-sectional schematic view, on a much larger scale, of the installation of FIG. 1, and in particular of the annular die and its support means, the centering projections being shown in a simplified manner.

The annular die 18 compries a mold 22 with an XX axis and a mandrel or cylindrical core 24 which defines therewith a narrow annular space 26 for casting the tube (FIG. 2), and which consequently should also be centered on axis XX.

The mold 22 is composed of a graphite cylinder which comprises, as its upper part, a truncated head or "lip" 23 immersed in the casting tank 16, and is surrounded by an envelope 30 defining a liquid metal cooling jacket with a low melting point, connected by pipes 31 and 32 respectively to a pressurized source of supply and to a discharge. Around envelope 30 is arranged an envelope of water 34 for cooling by circulation. The assembly of the mold 22 and the cooling envelopes is held in place by upper and lower flanges 27 and 28 which are fixed under the casting head 12 by bolt straps 29.

The core 24 is preferably composed of a hollow cylinder inside of which a heating coil 36 is mounted which occupies almost the entire internal cavity of the core, but which preferably does not extend down as far as the lower end of the core. At its upper end the core 24 has a flared, truncated head 38. As is clearly shown in FIG. 2, the length of the core 24 is considerably greater than the sum of the lengths of the mold 22 and the casting head 12, and this core traverses with play an orifice 40 in the upper part of the casting head in such a manner that the head 38 projects outside of the casting head.

Head 38 is supported above the casting head 12 by a cap 42 which is threaded on core 24 with the interposition of a sheath 44 which has a cylindrical lower part and a truncated upper part 45 and which adapts itself to the shape of the flared head 38. The upper surface 43 of cap 42 is planar, but its lower surface 46 is spherical and rests on the correspondingly shaped upper surface 48 of a fixed bed 50 mounted on the casting head 12 by screws 52. The bed 50 is annular and is coaxial to the orifice 40 for the passage of the core 24.

Cap 42 is firmly connected to the core 24 and to head 38, and is fixed by bolts 56 on a flange 58 which surrounds head 38 and takes support on the upper end of sheath 44. The flange 58 is also suspended by bolts 62 from an upper flange 60 which bears tightly against the upper surface of head 38. The support or suspension for core 24 is therefore essentially composed of head 38, sheath 44 and bed 50 fixed on the casting head 12. The combination of spherical surfaces 46 and 48 is considered as being a ball-and-socket joint.

The assembly composed of head 38 and core 24, sheath 44 as well as cap 42 solidly kept in place by flanges 58 and 60, is immobilized in relation to the casting head 12 by clamping flanges 64 traversed by bolts 66 fixed on the casting head 12 and tightened by nuts 68 which supply the flanges against the planar surface of the cap 42 and thus clamp the cap on the bed 50.

Figure 3:
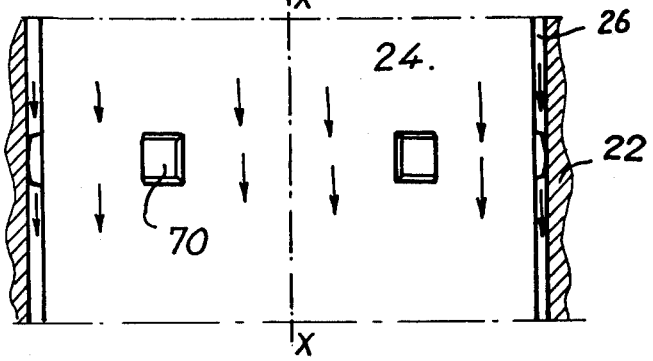
FIG. 3 is a partial view on an even larger scale of the core and its centering lugs in relation to the mold.
Figure 4:
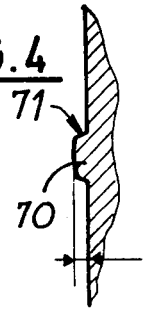
FIG. 4 is a partial view in meridian cross-section of an alternative projection for centering the core.

Core 24 also comprises, at an intermediate point, a series of graphite projections or lugs 70 regularly distributed around its periphery. They are cast with core 24 or can be separately affixed thereto. These projections 70, which are intended to contact the internal surface of the mold 22, are located on a part of the core 24 positioned at the upper part of the annular die 18 at the height of the truncated lip 23, and are therefore at the opening of the die in a zone where the cast iron poured into the annular space 26 is still liquid. The height or radical extension of each projection 70 from the wall of the core 24 corresponds to the width of the annular space 26 which defines the die. However, as is shown more clearly in FIGS. 3 and 4, the tops of the projections which contact the internal wall of mold 22 are not planar, but instead are preferably rounded. Each projection is defined by a surrounding sidewall 71, and can have a square base as shown in FIGS. 3 and 5, or a circular base as shown at 72 in FIG. 6.

Figure 5:
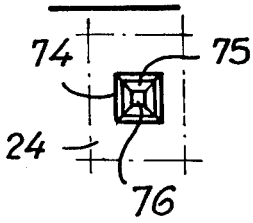
FIG. 5 is a front view of the projection of FIG. 4.
Figure 6:
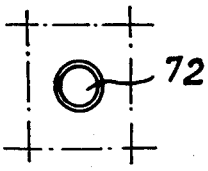
FIG. 6 is a partial view analogous to that of FIG. 5 of another alternative centering projection.

In accordance with the alternative of FIG. 5, core 24 comprises projections 74 which have a square base defined by four slanting sides 75 in such a manner that the top 76 which contacts the internal surface of the mold 22 has an extremely reduced and almost punctual surface.

Whatever the shape and method of production of the centering projections 70, 72, 74 which are borne by the core 24, they are placed so as to be located as close as possible to the opening of mold 22 at the height of the truncated lip 23 which is immersed in the casting tank, so as only to be in contact with the liquid metal.

The dimensions of the projections as well as the distance which separates them on the periphery of core 24 are chosen so that their total volume is low in relation to that of the annular space 26, thus only creating a negligible obstacle to the flow of the liquid cast iron. Consequently, the flow of the liquid is practically unchanged by their presence, and casting takes place in exactly the same manner as in their absence.

The centering of the core in relation to the mold, and consequently the regularity and quality of the tube produced, are therefore considerably improved.

In effect, during the assembly of the installation, when mold 22 has been mounted on casting head 12 and perfectly aligned with the axis XX of the extractor device 20, the mold may have considerable play in relation to the casting head due to manufacturing tolerances and the stress of the exterior sheet metal 13 of the head under the action of heat. It is therefore necessary to center core 24 in relation to both mold 22 and extractor 20, and not in relation to the casting head 12.

For this purpose, the sheath 44 and cap 42 are first fixed on core 24 and its head 38 by means of flanges 58 and 60. The core 24 is the introduced into orifice 40 of the casting head and is lowered to penetrate mold 22 until the centering projections engage the interior wall of the mold and adjust the position of the core. Cap 42 then abuts the upper surface 48 of bed 50 and, whatever the position of core 24 in relation to orifice 40 and the casting head, these two surfaces closely nest themselves one in the other. The immobilization of core 24 is then ensured by the flanges 64 held in place by bolts 66 and screws 68.

Of course, during this assembly it is still possible, in the neighborhood of the final suspension position of the core 24, to verify the perfect coaxiality of the core and mold 22 by introducing control templates into the lower annular space 26 of a size equal to the height of the projections. Should a slight deviation of the core be noticed, the spherical surface of cap 42 can be moved slightly in the desired direction in relation to bed 50 in order to again align the core perfectly in relation to the axis XX.

During casting, the liquid metal contained in the casting head, and in particular in channel 14 and tank 16, penetrates into the annular space 26 and flows in the direction of the arrows shown in FIG. 3, between and around the projections 70. These projections number six, for example, but they leave a large area for passage between them. Consequently no risk of solidification, or rather of a deposit followed by solidification, is to be feared in this centering zone.

It should be noted that the solidification frontier of the cast iron between its liquid and solid phases is located much lower, towards the output end of the annular die 18.

Likewise, no risk of movement of the core in relation to the mold, that is of off-centering of the core, is to be feared during casting. The annular space determining the thickness of the wall of the cast tube therefore remains rigorously constant at all times, and whatever the manufacturing tolerances of the various components of the installation.

What is claimed is:

1. An apparatus for supporting and centering a cylindrical core (24) inside an annular die (18) of a vertical continuous casting installation for thin tubes, comprising: a casting head (12) connecting a casting vessel (2) to a narrow annular space (26) of an annular die, a clampable ball-and-socket joint (42, 44, 46, 48, 50) disposed between an upper end (38) of an elongated, vertically depending core and an upper part of the casting head for supporting the core, means for clamping the ball-and-socket joint, the core traversing the casting head with a substantial degree of clearance, and the ball-and-socket joint enabling, when unclamped, lateral movement of said core upper end, and a series of identical, relatively small projections (70, 72, 74) regularly spaced around the periphery of the core substantially below the upper end thereof and in limited area contact with an internal wall of a mold (22) at the upper opening of the annular die at a level of immersion in the liquid metal during casting, whereby the core may be rocked about the projections in contact with the mold wall, with the ball-and-socket joint unclamped, to center the core in the mold inside the annular space of the die, whereafter the joint may be clamped to maintain such centering.

2. The apparatus of claim 1, wherein the upper end of the core is connected to a support cap (42) having a lower spherical surface (46) supported on an annular bed (50) having an upper spherical surface (48) fixed above the casting head coaxially to the annular die.

3. The apparatus of claim 2, wherein the upper end of the core is a flared head (38), and wherein the support cap is clamped under said head.

4. The apparatus of claim 1, wherein the projections for centering the core are disposed at the height of a truncated lip (23) of the mold which is immersed in a casting tank (16) of the casting head.

5. The apparatus of claims 1, 2 or 4, wherein the projections have tops (76) which have an almost punctual contact surface with the internal wall.

6. The apparatus of claim 5, wherein the tops of the projections are rounded.

7. The apparatus of claim 6, wherein the projections comprise truncated pedestals connected with the peripheral surface of the core by surrounding sidewalls (71, 75).

8. The apparatus of claim 7, wherein the tops of the projections are limited by four slanting sides (75).

9. The apparatus of claim 5, wherein the projections have a square base.

10. The apparatus of claim 5, wherein the projections have a circular base.

* * * * *